United States Patent [19]

Tarrson et al.

[11] Patent Number: 4,710,996

[45] Date of Patent: Dec. 8, 1987

[54] INTERDENTAL BRUSH HANDLE

[75] Inventors: Emanuel B. Tarrson; Dane Maric, both of Chicago, Ill.

[73] Assignee: John O. Butler Company, Chicago, Ill.

[21] Appl. No.: 895,872

[22] Filed: Aug. 12, 1986

[51] Int. Cl.[4] ..... A46B 3/08; A46B 9/04

[52] U.S. Cl. ..... 15/105; 15/206; 15/167.1; 132/89

[58] Field of Search ..... 15/105, 110, 111, 172, 15/176, 206; 132/89

[56] References Cited

U.S. PATENT DOCUMENTS

| | | | |
|---|---|---|---|
| 1,173,721 | 2/1916 | Hurvitz | 15/206 X |
| 1,996,205 | 4/1935 | Jackson | 15/167 R X |
| 3,559,226 | 2/1971 | Burns | 15/167 R |
| 4,222,143 | 9/1980 | Tarrson et al. | 15/167 R |
| 4,319,377 | 3/1982 | Tarrson et al. | 15/167 R |

*Primary Examiner*—Peter Feldman

*Attorney, Agent, or Firm*—Laff, Whitesel, Conte & Saret

[57] ABSTRACT

An elongated, preferably plastic handle has a sleeve lock on each of its opposite tip ends. When a twisted wire brush is placed in the handle and the sleeve is slipped over it, there is a guy wire effect from the sleeve which holds the brush firmly in place, as the sleeve stretches slightly over a bent end of the twisted wire of the brush. Each end of the inventive handle also has a tapered bore that may optionally hold the end of a wooden toothpick, which may be broken. The same sleeve which slips over the twisted wire stem of the brush, to anchor it in place, has a longitudinal cutout. The cutout is in the form of a cove opening into a funnel-shaped opening, with a nip between the cove and the funnel. The nip snaps over the toothpick to capture and hold it. The unbroken side of the sleeve which is opposite the cutout slips over the broken end of the toothbrush to help capture and cover it without leaving any exposed jagged fibers which could form splinters to damage mouth tissues.

11 Claims, 11 Drawing Figures

INTERDENTAL BRUSH HANDLE

This invention relates to instruments for home dental care and, more particularly, to handles for specialized brushes used to clean the areas of the roots of and the interdental spaces between and around human teeth.

Brushes and handles for cleaning interdental spaces are shown and described in U.S. Pat. Nos. 3,559,226; 4,222,143; and 4,319,377.

An interdental brush serves two purposes which are removing plaque from the tooth and massaging the mouth tissue. An important part of a toothbrush for accomplishing these two purposes is the tip ends of the bristles, which provide the greatest amount of cleaning. When a person cross brushes his teeth, these tip ends tend to brush the flat surfaces and to completely miss the curvature of the tooth surfaces.

There are places in the interdental areas which are difficult to reach with a normal toothbrush regardless of how the brushing is carried out. Thus, the normal toothbrush fails to provide true cleaning power for those interdental parts of the tooth which are most likely to decay.

Another difficult place to clean is at the gumline or the margin between the hard tooth surface and the soft mouth tissue surface. As the brushing is carried out, the bristles may be active in an area below the apparent gumline or margin between gum and tooth. Thus, it is important to brush interdentally along the margin between gum and teeth.

To maintain healthy gum tissue, it is highly desirable to provide means for and methods of massaging that tissue. As the massaging occurs, the gum tends to develop a thicker and healthier surface layer for resisting an attack by either disease or mechanical abrasion. However, massaging in these areas presents a number of problems. The closely spaced interdental areas and the margin or gumline are usually difficult to reach, especially at the back of the mouth, between, and around the teeth. Therefore, it is difficult to properly stimulate the gums, brush the gumline, and remove the plaque in these noted and other areas.

A number of aids (including various brushes) have been designed for performing this kind of brushing and massaging. A brush which is most likely to brush in this manner within the interdental spaces is a "twisted wire" type brush wherein bristles are captured between and extended radially from a pair of twisted wires. If the twisted pair of wires must pass through the space between the teeth, the diameter of the wires forming the twisted wire stem should be thin.

The users have different needs depending upon the individual characteristics and construction of and spacing between their teeth. Therefore, it is common practice to provide several different brush designs and configurations. Some brushes may have an outline which is a conical shape and others may have an outline which is a cylindrical shape. Some brushes have a relatively larger diameter and others have a smaller diameter. A very important consideration is the width of the space between the teeth. The same dental arch may have relatively large interdental gaps at one place and relatively small gaps at another place. Thus, it is desirable to provide a handle for receiving any of many different types of brushes which may be used interchangably during the same brushing.

Accordingly, it becomes necessary to provide a handle which can hold the brush firmly while in use and to hold the twisted wire securely along an extended length thereof. If the brush is to project perpendicularly from the tip of the handle so that it may move sideways to brush into the interdental areas, it becomes even more difficult to lock the twisted wires in place. Unless so locked, the brush is likely to rotate about the axis of the handle or to bend when it is in use. For example, both of the U.S. Pat. Nos. 4,222,143 and 3,559,226 show handles for holding an interdental brush.

A toothpick is another aid for cleaning the same general interdental area of tooth and the margin between tooth and gum. For many reasons which are unimportant here, the most accepted toothpick is a wooden one. However, it is very difficult to work a toothpick between the teeth, especially at the back of the mouth. Therefore, it is also desirable to provide a handle for holding a wooden toothpick projecting at approximately a right (or other convenient) angle thereto.

If the handle so holds a projecting wooden toothpick, the wood must be severed on the opposite side of the handle so that the unused end of the toothpick does not project from the handle. The easiest way to sever the toothpick is simply to break it. However, then there are likely to be sharp, projecting, broken ends of wood fibers, which may leave splinters in the mouth tissue.

The foregoing considerations resulted in a development of the metal brush handles that are shown and described in U.S. Pat. Nos. 3,559,226 (Burns); 4,319,377 (Tarrson et al.); and a plastic brush handle that is shown and described in U.S. Pat. No. 4,222,143 (Tarrson et al.). These handles hold a brush and a toothpick. Sometimes, the toothpick loosened and did not always remain in place. Also, the handles had only one twisted wire brush. If the user has a need to use two different types of brushes, he had to change brushes or use two separate brushes as he moved his brushing from place to place within his mouth. For example, if he has interdental gaps with a variety of widths, he might require a conical brush at one location in his mouth and a cylindrical brush in another part of his mouth. Thus, these brushes were not as convenient as they might be.

Accordingly, an object of the invention is to provide new and improved handles for interdental brushes. Here, an object is to provide such handles which may be used with different types of brushes without having to continuously change brushes. In this connection, an object is to enable a person with a variety of interdental gap widths to brush his teeth without having to change brushes during a single brushing.

Another object is to provide a handle which may be loaded with either a toothbrush and toothpick, or with two toothbrushes. Here, an object is to provide a chuck which securely holds a relatively large diameter toothpick, or alternatively, which holds a relatively small diameter brush equally securely.

Still another object of the invention is to accomplish these and similar objects with a commercially attractive product.

Yet another object is to provide a toothpick holder which may receive and hold the broken end of a wooden toothpick without exposing soft mouth tissues to any danger from splinters at the broken ends of the wooden fibers.

In keeping with an aspect of the invention, these and other objects are accomplished by an all plastic, elongated handle having on both of its ends a smooth and unthreaded sleeve which slides back and forth. Two transverse, spaced parallel, holes pierce each of the tip ends of the handle. One of the two holes on each end has a relatively small diameter which is just large enough to easily receive a twisted pair of wires with little, if any, resistance. However, its diameter is not large enough to permit a significant amount of wiggling movement. Extending from this brush hole and back along the handle, a downwardly slanting groove is molded into the plastic, to receive the end of the twisted wires, which project above the surface of the handle at the highest point of the downwardly slanting groove. The cross sectional shape of the sleeve is deformed as it passes over the hump to produce a guy-wire-like effect, which holds the brush in a chuck-like grip.

In addition to the small diameter, transverse hole for receiving the wire stem, each end of the handle also includes a relatively large diameter, preferably tapered hole which may be countersunk into a recessed area on one side. A wooden toothpick wedges into the tapered hole. A sleeve slides over each end of the handle to capture the wire stem in a similar manner to the way in which the wire stem is captured in the prior art handle of U.S. Pat. No. 4,222,143. One side of the same sleeve also has a longitudinally extending funnel-shaped opening leading through a nip to a cove which fits around the toothpick to capture and hold it. The opposite side of the sleeve slips over the broken, splintered end of the toothpick to prevent it from becoming dislodged and to further protect mouth tissue from splinters. This way, no sharp, jagged and broken ends of wood fibers can damage the tissues of the mouth.

A preferred embodiment of the invention is seen in the attached drawings, wherein.

Figure 1:
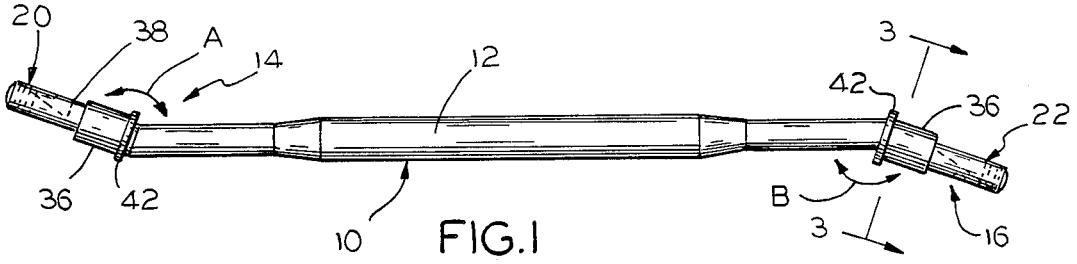
FIG. 1 is a side elevation of the inventive interdental handle.

The inventive handle (FIG. 1) comprises a generally elongated handle member 10 which has a thickened central region 12, terminated on either end in sections 14, 16 of reduced diameter. Each of these end sections 14, 16 is bent at an obtuse angle A,B of approximately 160 to 150 degrees with respect to the axis of the elongated handle member 10. At each tip end of the handle 10, there is a pair of spaced parallel transverse holes or bores at 20, 22 extending through the end sections of the handle, the axes of the holes being in the plane including the angles A and B. Preferably, the handle is made from a molded plastic.

Figure 2:
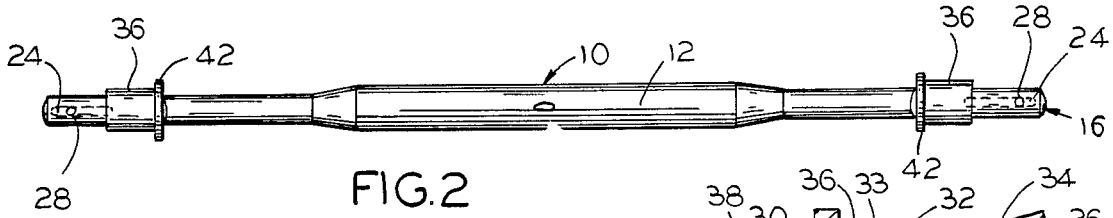
FIG. 2 is a plan view of the inventive handle rotated by 90° away from the position shown in FIG. 1.
Figure 7:
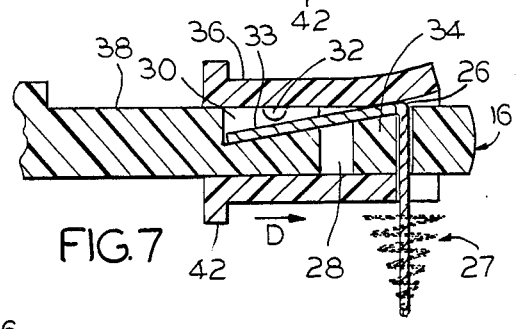
FIG. 7 is a cross section of the tip end of the inventive handle with a wire stem brush in captured position.

The hole or bore 24 (FIG. 2) has a diameter which is only a very small amount greater than the maximum diameter of a pair of twisted wires (preferably stainless steel) which form the stem 26 and anchored end of the interdental brush 27 (FIG. 7). Therefore, the brush stem formed by these twisted wires slips easily through the hole or bore 24, but it does not wiggle within the hole, in a significant degree. The hole or bore 28 receives, with a snug fit, and end of a preferably wooden toothpick which fits through the hole with sufficient friction to hold the toothpick in place.

Figure 9:
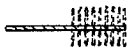
FIGS. 9 and 10 are side views of two exemplary types of twisted wire brushes.
Figure 10:
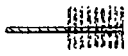

The brush 27 is more or less conventional in its twisted wire construction. It may have any shape which serves interdental and root brushing needs. For example, the brush 27, shown in FIG. 7, is conical, while FIGS. 9 and 10 show it as being cylindrical. The difference between FIGS. 9 and 10 is that FIG. 9 has relatively thin bristles to make a brush of medium harness, while FIG. 10 has relatively thick bristles to make a hard brush. These bristles may be either natural or a plastic, preferably nylon. The point is that a separate handle and brush construction enables a use of any of a plurality of different kinds of brushes.

Figure 3:
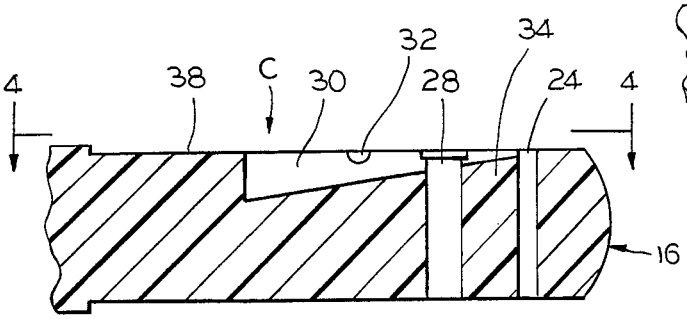
FIG. 3 is a cross sectional view of the tip end of the handle, taken along line 3—3 of FIG. 1.
Figure 8:
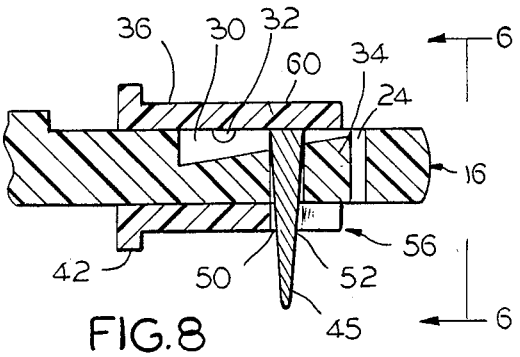
FIG. 8 is a cross section of the tip end of the inventive handle with a toothpick in a captured position.
Figure 4:
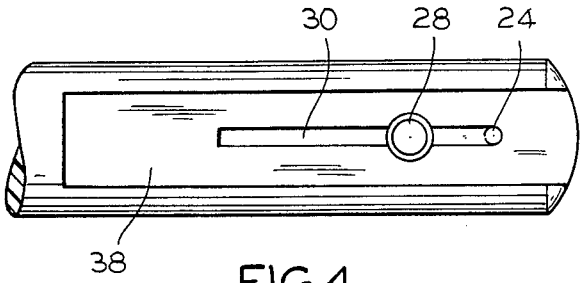
FIG. 4 is a plan view of the tip end taken along line 4—4 of FIG. 3.

The end of the handle tip containing the spaced parallel holes or bores 24, 28 is seen in cross section in FIGS. 3, 7, and 8. There is a thumbnail groove or locking slot 30 which is wide enough to receive the end of the twisted wire stem 26 and is long enough to receive a fairly precise length of the twisted wires, which will insure that the brush projects a predetermined distance beyond the other side of the handle when the wire end of stem 26 is bent over and pressed into the thumbnail groove or locking slot 30. In one embodiment, the slot length was approximately 0.330 inches. The slot begins at hole 24, from which the slot bottom slopes downwardly toward an end removed from said bore so that the end of the twisted wire stem may be pushed downwardly in direction C, for only a predetermined distance. A depression 32 my extend perpendicularly across the slot and receives the edge of a thumbnail.

Figure 6:
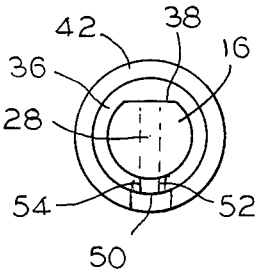
FIG. 6 is an end view of the inventive sleeve taken along line 6—6 of FIG. 8.

The instructions to the user may suggest either of two ways to go about locking the brush in place. First, the user may bend the free end of the twisted wire stem 26 forward over the tip end of the handle. This forms the twisted wire to have a substantially right angle bend over the tip end. The bent end 33 (FIG. 6) is then rotated to fit down and into the slot 30. Second, the user may bend the free end 33 of the twisted wire stem 26 backward over the slot 30 and then downwardly, as viewed in FIG. 7. The end 33 fits into the slot 30 and is pushed downwardly by the thumbnail pressed into the depression 32. Either way, the free end of the twisted wire stem rests in the slot 30, as best seen in FIG. 7.

The slot 30 begins at a shoulder 34 which is recessed below the surface of the handle by a distance which is, roughly speaking, about equal to the radius of the twisted pair of wires. In one embodiment, a pair of twisted wires had a diameter in the range of 0.028–0.08 of an inch in diameter. The shoulder 34 was recessed at about 0.018 of an inch below the surface of the handle. The distant end of slot 30 had a depth of approximately 0.060 of an inch, in this embodiment.

Thus, the twisted wire stem 26 projects above the surface of the handle and forms an obstruction there, in order to limit the forward sleeve travel and to deform the sleeve to produce a guy-wire-like effect.

Sleeves 36 are shaped an proportioned to slide back over the reduced diameter end sections 14, 16 of the handle far enough to expose all of the thumbnail groove 30 or forward far enough to lock the brush or a toothpick in place. The interior of the sleeve has a contour which is generally cylindrical with a flat side 38 throughout its length. The sleeve 36 terminates in an annular ridge 42 which assists in holding and moving it.

Figure 11:
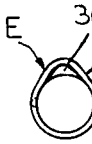
FIG. 11 is an end view of a sleeve locking a brush in place.
Figure 5:
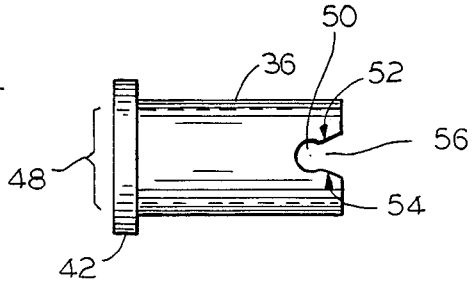
FIG. 5 is a plan view showing the bottom of a sleeve used on the inventive handle to lock both the wire stem toothbrush and the toothpick in place.

After the brush is in place and the end 33 of the twisted wire stem 26 has been bent over, the sleeve 36 is forced as far as it will go in direction D (FIG. 7). The hump formed by the twisted wire stem bending over the shoulder 34 forms an obstruction which limits the outward sleeve movement and prevent its removal from the end of the handle. Moreover, the sleeve tends to be distorted in cross section to provide a bracing effect which is somewhat similar to the bracing of guy wires, thereby forming a very tight binding. The guy wire effect is caused by a deformation of the end of sleeve 36 as seen at E,F in FIG. 11. The tension in sleeve 36 helps secure the twisted wire stem 26 and, thus, the brush 27 in place. This firm anchoring of the twisted wires 24 wrapping over the shoulder 34 helps to stabilize the brush when it is thus locked in position.

In addition to the wire stem receiving hole 24, each end of the handle 10 also includes a tapered relatively large diameter bore or hole 28 for receiving a toothpick 45 (FIG. 8) which may be wedged into it. Thereafter, the toothpick may be snapped off. Extending longitudinally along one side of the sleeve 36 is a generally C-shaped cutout cove 50 opening through a nip 52, 54 with a somewhat funnel-shaped opening 56. The junction 52, 54 between the cove 50 and the funnel opening 56 forms a nip for snapping around, capturing, and holding a toothpick.

The end view (FIG. 6) of the tip end 16 illustrates the relationship between the handle and the sleeve. The flat sides 38 of the sleeve 36 and handle tip 16 form an indexing means which insures that the sleeve 36 has the correct rotational orientation around the axis of the tip end 16, with respect to the toothpick hole 28 and the cove in the longitudinal slot. Thus, as the sleeve 36 slides forward, the toothpick 45 (FIG. 8) in hole 28 automatically fits into the funnel-shaped opening 56 which guides it into the cove 50.

Since the nip 52, 54 at the entrance of cove 50 forms an entrance throat which is slightly more narrow than the diameter of the toothpick 22, the sleeve cove snaps over the toothpick. The top and unbroken surface 60 (FIG. 8) of the sleeve fits over the upper, raw, and broken end of the toothpick 45, thereby protecting the user from the splinters at the broken end of the toothpick. Thus, either or both ends 14, 16 (FIGS. 1, 2) of the handle may receive either a brush or a toothpick.

Those who are skilled in the art will readily perceive how the invention may be modified, without departing from the scope and the spirit of the invention.

The claimed invention is:

1. An elongated interdental toothbrush handle having a spaced parallel pair of transverse bores near at least one tip end thereof, the diameter of a first bore in said pair of bores having a relatively small diameter which is slightly greater than the diameter of a twisted pair of wires of a twisted wire brush, a locking area formed in said handle and extending away from said first of said pair of bores, the locking area beginning at a shoulder and thereafter sloping downwardly to an end which is removed from said first bore, said shoulder being formed in said handle to expose said twisted wire above the surface level of the handle, the end of said locking area being removed from said bore being low enough to enable an end of said twisted wire to be bent over said shoulder and pressed below the surface level of said handle, the second in said pair of bores having a relatively large diameter into which a wooden toothpick may be forced and then snapped off, and a sleeve associated with said tip end for sliding over said end of said twisted wire to come to rest against the twisted wire which is exposed above said surface of said handle at the shoulder where the wire is bent over, said sleeve having a cove for receiving and a nip for capturing said toothpick, the part of said sleeve which is opposite said cove slipping over the broken top where said toothpick is snapped off.

2. The handle of claim 1 wherein said cover on each of said sleeves has a somewhat funnel-shaped entrance leading to the nip which forms a throat which is slightly more narrow than the diameter of said toothpick whereby said sleeve snaps over, captures, and holds said toothpick.

3. The handle of claim 2 wherein there is a pair of said transverse bores and one of said sleeves on each of two opposing ends of said elongated handle.

4. The handle of claim 3 wherein each of said relatively small diameter first bores for receiving said twisted wire is closer to the tip end of said handle than said relatively large diameter second bores for receiving said toothpick.

5. A handle for receiving and supporting interdental brushes, said handle comprising an elongated member having oppositely disposed tip ends which form an obtuse angle with respect to an axis of said elongated member, means on at least one of said tip ends for receiving and capturing either an individually associated twisted wire brush or a toothpick, and sleeve means slidable over said tip ends, said sleeve having an elongated slot for receiving said twisted wire brush and for capturing said toothpick, a side of said sleeve opposite said elongated slot capturing said twisted wire brush and covering a broken end of said toothpick whereby at least sid one tip end may optionally receive either a brush or a toothpick.

6. The handle of claim 5 wherein said elongated slot is a longitudinal cutout forming a cover in series with a funnel-shaped opening, a nip formed between said cove and said opening for snapping over and capturing said toothpick.

7. The handle of claim 6 wherein said twisted wire brush has a stem which forms an obstacle that projects above said handle at said one tip end, said other side of said sleeve being deformed when said sleeve is pushed over the obstacle formed by said projecting twisted wire stem, said deformed sleeve producing a guy wire effect upon said twisted wire.

8. The handle of claim 5 wherein said means for receiving either said twisted wire brush or said toothpick comprises a pair of spaced parallel holes extending transversely through each of said tip ends and lying in a plane in which includes said axis of said handle.

9. The handle of claim 8 wherein there is a pair of said spaced parallel holes and one of said sleeves on each of said opposed tip ends.

10. The handle of claim 9 wherein the one of said pair of holes which is nearest each of the tip ends has a relatively small diameter which is approximately equal to the diameter of said twisted wire and the other of said pair of holes which is furthest from each of said tip ends has a relatively large diameter which is approximately equal to the diameter of said toothpick.

11. The handle of claim 5 wherein there is a pair of said spaced parallel holes and one of said sleeves on each of said opposed tip ends, the one of said pair of holes which is nearest the tip end has a relatively small diameter which is approximately equal to the diameter of said twisted wire and the other of said pair of holes which is furthest from said tip end has a relatively large diameter whic is approximately equal to the diameter of said toothpick.

* * * * *

UNITED STATES PATENT AND TRADEMARK OFFICE

CERTIFICATE OF CORRECTION

PATENT NO. : 4,710,996

DATED : December 8, 1987

INVENTOR(S) : Tarrson and Maric

It is certified that error appears in the above—identified patent and that said Letters Patent is hereby corrected as shown below:

Col. 4, line 9, "and" should read --an--.

Col. 4, line 67, "an" should read --and--

Col. 6, Claim 2, line 1, "cover" should read --cove--

Col. 6, Claim 5, line 42, "sid" should read --said--

Col. 6, Claim 6, line 45, "cover" should read --cove--

Col. 8, Claim 11, line 5, "whic" should read --which--

Signed and Sealed this

Thirty-first Day of May, 1988

*Attest:*

*Attesting Officer*

DONALD J. QUIGG

*Commissioner of Patents and Trademarks*